US008926446B1

(12) United States Patent
Jones

(10) Patent No.: US 8,926,446 B1
(45) **Date of Patent: *Jan. 6, 2015**

(54) PUTTING TRAINING DEVICE

(71) Applicant: Herman L. Jones, Wenatchee, WA (US)

(72) Inventor: Herman L. Jones, Wenatchee, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/086,634

(22) Filed: Nov. 21, 2013

Related U.S. Application Data

(63) Continuation of application No. 13/529,953, filed on Jun. 21, 2012, now Pat. No. 8,591,349.

(60) Provisional application No. 61/499,796, filed on Jun. 22, 2011.

(51) Int. Cl.
*A63B 69/36* (2006.01)

(52) U.S. Cl.
CPC ..... *A63B 69/3676* (2013.01)
USPC ..... 473/229; 473/258

(58) Field of Classification Search
CPC ..... A63B 69/36; A63B 69/3676
USPC ..... 473/221, 222, 225, 229, 257, 258, 259, 473/260, 261
See application file for complete search history.

(56) References Cited

U.S. PATENT DOCUMENTS

| | | | | |
|---|---|---|---|---|
| 2,084,901 | A | 6/1937 | Eisenberg | |
| 3,953,035 | A * | 4/1976 | Beckisk | 473/229 |
| 4,133,535 | A | 1/1979 | Marsh | |
| 4,334,684 | A | 6/1982 | Sterling | |
| 4,437,669 | A | 3/1984 | Pelz | |
| 4,583,738 | A | 4/1986 | Fava | |
| 4,700,949 | A | 10/1987 | Nottoli | |
| 5,074,565 | A | 12/1991 | Tucker | |
| 5,467,993 | A * | 11/1995 | Higginson | 473/229 |
| 6,551,197 | B1 * | 4/2003 | Travo | 473/258 |
| 6,893,356 | B2 | 5/2005 | Thompson | |
| 7,074,133 | B1 | 7/2006 | Jones et al. | |
| 7,883,429 | B1 * | 2/2011 | Chen | 473/258 |
| 8,298,094 | B1 | 10/2012 | Chen | |
| 8,591,349 | B1 * | 11/2013 | Jones | 473/229 |
| 2006/0116214 | A1 | 6/2006 | Tiziani et al. | |

* cited by examiner

*Primary Examiner* — Nini Legesse

(57) ABSTRACT

The disclosed training device is an apparatus where in one form a user stands upon the upper surface of the platform, grasps the handle of a golf club, and swings the golf club and attached carriage laterally through an arc along the base rail. Thus, the head of the putter would swing back and forth in a correct angle and arc to establish and reinforce a correct muscle memory to the user. This formalized repletion would establish and/or reinforce the correct form and swinging of the golf club 36. This muscle memory would be maintained when the golf club is not attached to the putting training device.

20 Claims, 9 Drawing Sheets

PUTTING TRAINING DEVICE

RELATED APPLICATIONS

This application is a continuation of U.S. Ser. No. 13/529,953, filed Jun. 21, 2012 claiming priority benefit of U.S. Ser. No. 61/499,796, filed Jun. 22, 2011 and incorporated herein by reference.

BACKGROUND OF THE DISCLOSURE

Field of the Disclosure

This disclosure relates to the field of golf training devices. Specifically, to a golf training device used to improve a golfer's swing while putting, or chipping.

SUMMARY OF THE DISCLOSURE

Disclosed herein is a golf swing training device comprising several novel components which may be arranged in different configurations. The device in one configuration comprises: a platform; a support leg having a first end pivotally connected to the platform and extending vertically therefrom; a substantially rigid base rail pivotally coupled to a second end of the support leg; a carriage plate positionally attached to the base rail so as to reposition relative thereto through a swing arc; and a golf club handle clamp attached to the carriage plate so as to fixedly attach a golf club thereto.

The golf swing training device may also include a plurality of rollers which are attached to the carriage plate and configured to engage the base rail so as to reduce friction there between. These rollers may have an outer surface which is concave relative to the rotational plane so as to maintain position on the base rail or on the sub rails.

The golf swing training device may also be configured wherein the platform comprises an upper surface upon which a trainee stands. This platform may utilize the trainee's own weight to stabilize the device.

The golf swing training device may further comprise: a carriage pivot installed between the carriage plate and the golf club handle clamp so as to allow for selective adjustment of the golf club handle clamp relative to the carriage plate. This adjustment is in a vertical plane and is substantially perpendicular to the base plate. Using this carriage pivot, the carriage pivot is generally fixed in place during operation of the training device.

The golf swing training device may further comprise a clamp slide positioned between the carriage plate and the golf club handle clamp to allow for selective linear and vertical adjustment of the golf club handle clamp relative to the carriage plate. As with the carriage pivot, generally the clamp slide is fixed in place during operation of the training device.

The golf swing training device may also comprise an upper and a lower sub rail attached to upper and lower portions of the base rail respectively. The carriage plate is normally positionally attached to the sub rails so as to slide or roll thereon. Rollers may be attached to the carriage plate so as to rotate relative to the carriage place, and may comprise a concave outer surface which engages the outer surface of the sub rails. The sub rails themselves may be substantially cylindrical, and bent into an adjustable arc.

The golf swing training device may also comprise a sub rail position adjustment system wherein the position of one or both of the upper and lower sub rails may be adjusted relative to the base rail. The sub rail position adjustment system is also normally fixed in place during operation of the training device. This sub rail position adjustment system allows for different radiuses of swing, and may also allow the distance between the sub rails to be adjusted. By adjusting the relative spacing of the sub rails, the trajectory of the club may be adjusted.

The golf swing training device may further comprise a first carriage sub plate pivotally attached to the carriage plate and positionally attached to the upper sub rail and; a second carriage sub plate pivotally attached to the carriage plate and positionally attached to the lower sub rail.

The golf swing training device may further utilize a tilt adjustment system between the base rail and the support. The tilt adjustment system provides for selective adjustment of the base rail relative to the support leg in a vertical plane perpendicular to the base rail. Generally, the tilt adjustment system is fixed during operation of the training device.

The golf swing training device may further comprise a height adjustment system between the platform and the base rail. The height adjustment system allows for the vertical position of the base rail to be selectively adjusted. As with other adjustment systems, the height adjustment system is normally fixed during operation of the training device.

The golf swing training device may further comprise: a support strut having a first end pivotally attached to the platform. Wherein the support strut in one form has a second end pivotally attached to the support leg.

The golf swing training device may also utilize a support strut length adjustment system. The support strut length adjustment system thus provides for adjustment of the distance between the first end and the second end of the support strut. Thus, the angle of the support leg relative to the platform may be selectively adjusted.

The golf swing training device may be configured wherein the support leg comprises a left side leg and a right side leg each independently attached to the platform; and wherein each of the left side leg and right side leg are independently attached to the base rail.

The golf swing training device may alternatively be configured wherein each of the left side leg and right side leg comprise a height adjustment system independent of the height adjustment system of the opposing side leg.

The golf swing training device may further comprise: a left side support strut having a first end pivotally attached to the platform; and the left side support strut having a second end pivotally attached to the left side leg; a right side support strut having a first end pivotally attached to the platform; and the right side support strut having a second end pivotally attached to the right side leg.

The golf swing training device may be arranged wherein each of the left side support strut and right side support strut comprise a length adjustment system independent of the length adjustment system of the opposing support strut.

DESCRIPTION OF THE PREFERRED EMBODIMENTS

Figure 1:
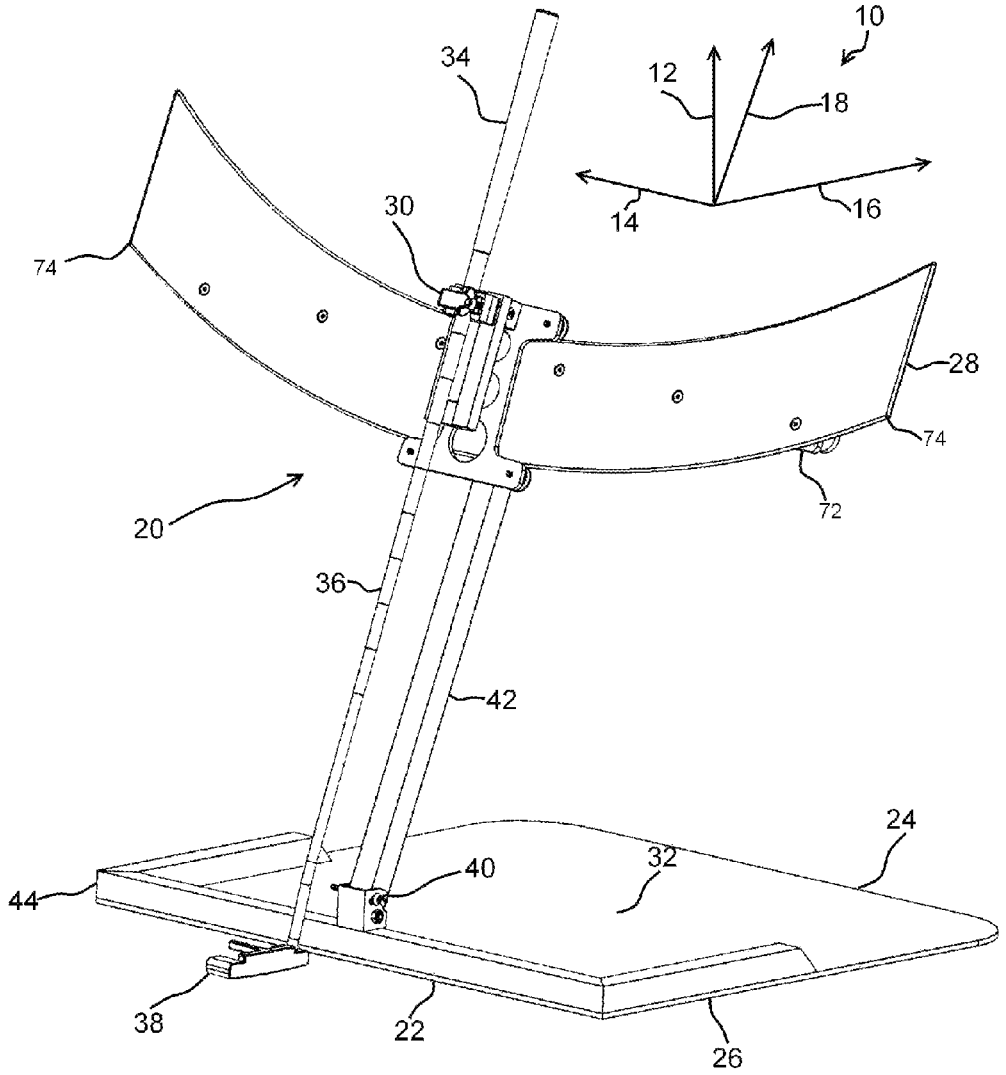
FIG. 1 is an isometric perspective view of one embodiment of the invention.

The disclosed training device is an apparatus where in one form a user stands upon the upper surface 32 of the platform 24, grasps the handle 34 of a golf club 36, and swings the golf club 36 and attached carriage 30 laterally through an arc along the base rail 28. Due to the nature of the base rail and the way the carriage is mounted to the base rail, the user must swing the club through a prescribed arc. Thus, the head 38 of the putter 36 is forced too swing back and forth in a correct angle and arc which establishes and/or reinforces a correct muscle memory to the user. This formalized repletion would establish and/or reinforce the correct form and swinging of the golf club 36. This muscle memory would be maintained when the golf club is not attached to the putting training device 20.

Before beginning, a detailed description, an axes system 10 is shown in FIG. 1 comprising a vertical axis 12, lateral axis 14, a transverse axis 16, and a club alignment axis. The lateral axis 14 is parallel to the front edge 22 of the platform 24, and the transverse axis 16 is parallel to the side edge 26 of the platform 24. The vertical axis 12 is orthogonal to both the lateral axis 14 and transverse axis 16. The club alignment axis 18 is generally aligned with the longitudinal axis of the shaft of the golf club. These axes are intended to aid in description of the particular embodiments, and are not intended to be limiting.

The golf training device 20 generally comprises three interoperating portions. These portions being: the platform 24, a base rail 28, and a carriage 30. To gain a better understanding of some of the solutions previously addressed, a review of prior patents such as U.S. Pat. Nos. 7,862,444, 7,670,233, and 7,144,340 incorporated herein by reference, is suggested.

The disclosed training device is an apparatus where in one form a user stands upon the upper surface 32 of the platform 24, grasps the handle 34 of a golf club 36, and swings the golf club 36 and attached carriage 30 laterally through an arc along the base rail 28. Thus, the head 38 of the putter 36 would swing back and forth in a correct angle and arc to establish and reinforce a correct muscle memory to the user. This formalized repletion would establish and/or reinforce the correct form and swinging of the golf club 36. This muscle memory would be maintained when the golf club is not attached to the putting training device 20.

To allow for easier portability, in one form a locking pivot 40 is formed between a support 42 and the platform 24. In one form, a portion of the locking pivot 40 is attached to a frame portion 44 of the platform 24. This frame portion 44 adds stability and rigidity to the overall device 20.

Figure 2:
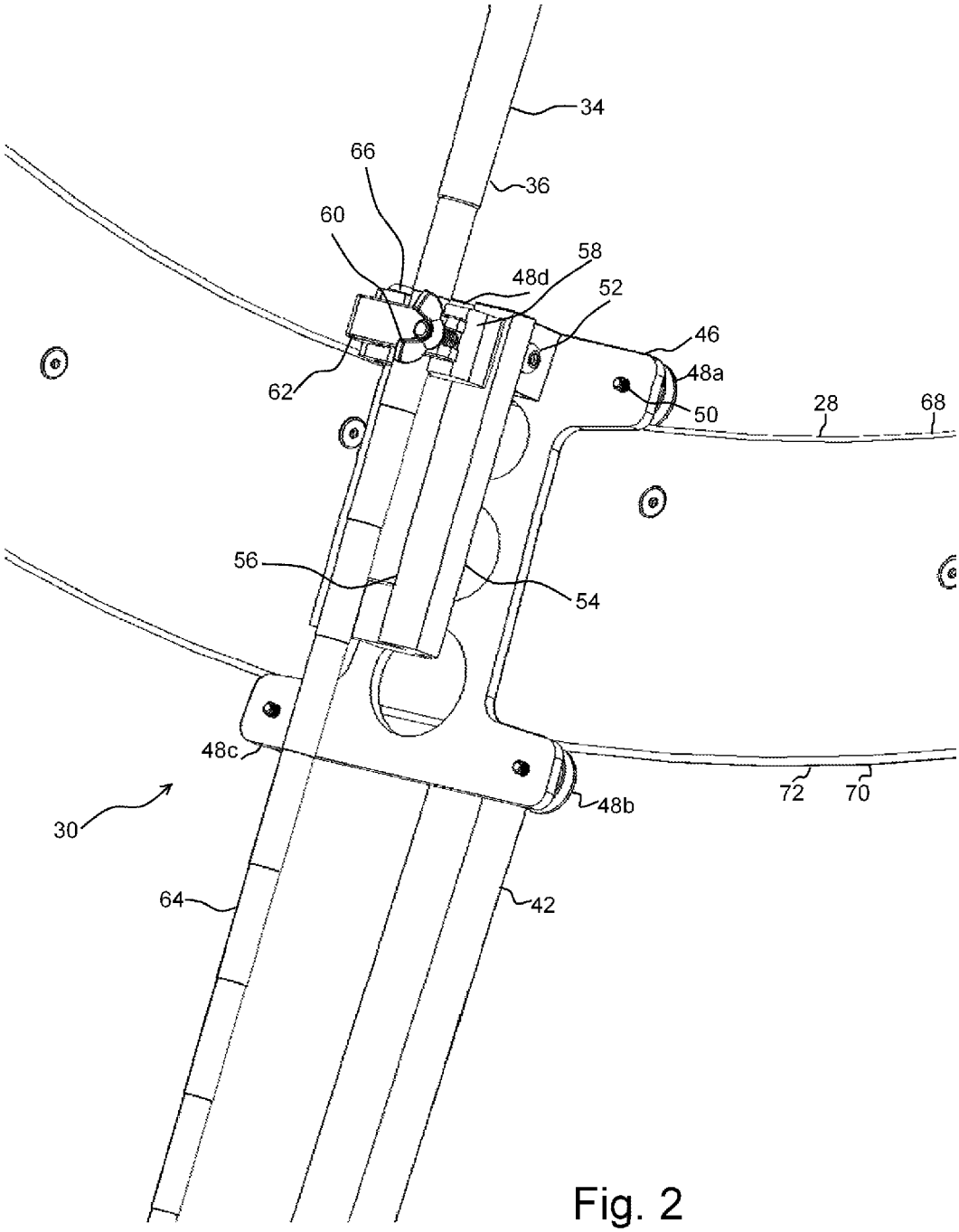
FIG. 2 is an isometric detail view of the embodiment shown in FIG. 1.

Looking to FIG. 2, one embodiment of the carriage 30 can more easily be seen. In this embodiment, the carriage 30 comprises a carriage plate 46 having a plurality of rollers 48 each attached thereto and configured to rotate about an axis 50. In one form, the rollers have a concave outer surface in the rotational plane so as to engage the contact surface of the base rail 28 and maintain engagement thereupon. While the numeric identifier 48 is used to denote rollers in general, particular rollers are indicated with an alphanumeric suffix A-D in this configuration.

In one form a carriage pivot 52 is attached to the carriage plate 46 and a clamp slider 54 is pivotably attached thereto and configured to rotate about the carriage pivot 52 relative to the carriage plate 46. The clamp slider 54 comprises a surface 56 to slideably attach a clamp 58 thereto or upon the clamp 58 is configured to selectively reposition linearly relative to the clamp slider 54.

In one form, a fixing device is utilized to hold the clamp 58 and maintain relative position of the clamp 58 to the clamp slider 54 once the correct orientation is achieved. In one form, a wing nut 60 achieves this purpose while at the same time providing the clamp body 62 with a tensioning mechanism to rigidly hold the shaft 64 of the golf club 36 therein. In one form, the clamp body 62 pivots about a clamp pivot 66.

In the embodiment shown in FIGS. 1 and 2, the rollers 48 allow the carriage 30 to ride upon the upper edge 68 and lower edge 70 of the base rail 28. These edges 68 and 70 form a proper swing plane through which the golf club 36 travels to form muscle memory in the user to improve their golf swing. In one form, a plurality of bumpers 72 may be provided to limit the lateral swing of the carriage 30 so that the rollers 48 do not extend between the lateral extreme corners 74 of the base rail 28 which would be obviously detrimental.

Figure 3:
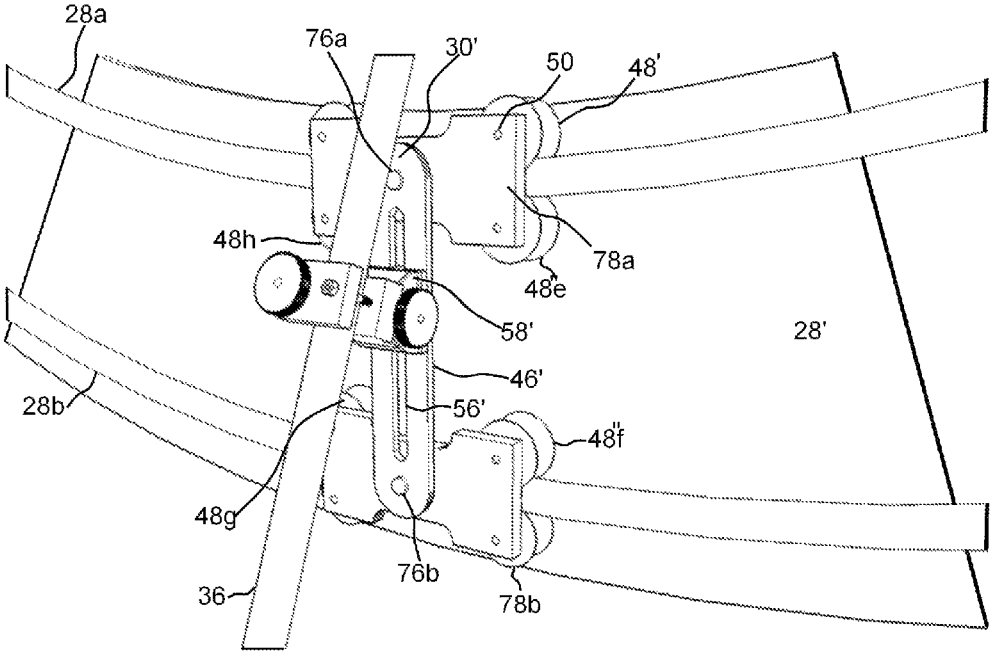
FIG. 3 is a detail view of a second embodiment of the invention.

Looking to the configuration shown in FIG. 3, the carriage 30' is configured differently from that shown in FIG. 2 in that the carriage 30' including a plurality of transverse carriage pivot's 76A and 76B which allow carriage sub plates 78A and 78B to function independently. In this configuration, elements with similar functions to those of the first configuration share the same numerical identifier, with an apostrophe to distinguish them form the first configuration. In addition, the outer rollers 48' are paired with inner rollers 48". An alphanumeric suffix is again used to denote specific rollers. This configuration of the carriage 30' roles upon a plurality of sub rails 28'A and 28'B attached to the base rail 28', the inner rollers 48'E-H hold the carriage sub plates 78A and 78B upon the sub rails.

In addition, a surface 56' may provide for sliding movement between the clamp 58' and carriage plate 46' is formed somewhat different from the figuration shown in FIG. 2. In the configuration shown in FIG. 3, this surface 56' generally provides a slot, through which a fastener or tensioning member may be passed to maintain the clamp 58' upon the carriage plate 46' and allow for linear repositioning along the surface 56'.

Figure 4:
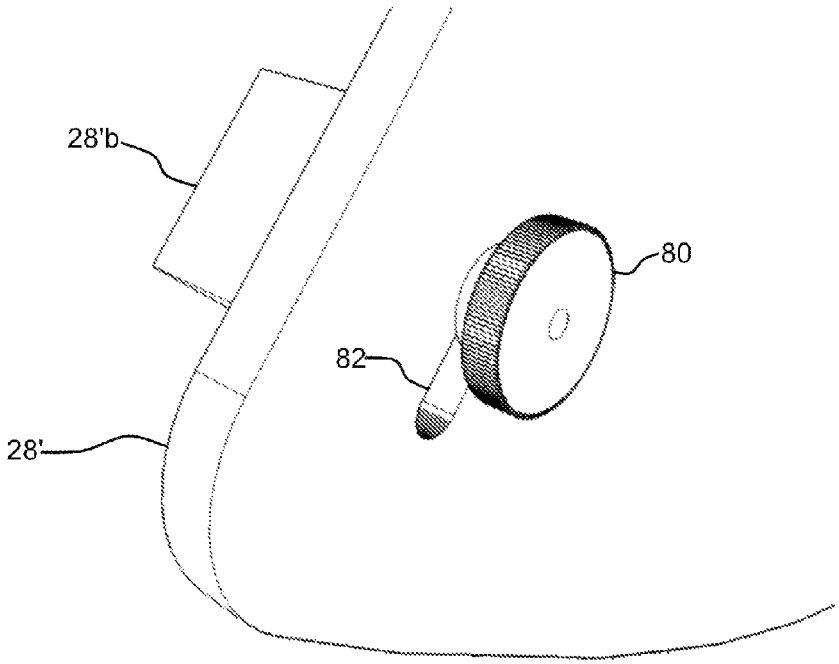
FIG. 4 is a detail view of an adjustment system in one embodiment of the invention.

The configuration shown in FIG. 3 allows for variation of the swing arc in the swing plane as can be understood by looking to FIG. 4 which shows the back side of the base rail 28' and an adjustment knob 80 which passes through a channel 82 in the base rail 28' and attaches to the sub rail 28'*b*. This adjustment allows for variation in the swing plane not only when both sub rails 28' are moved in conjunction, but also provides for additional movement of the golf club 36 when the distance between the sub rails 28 is modified at these adjustment knobs 80.

Figure 5:
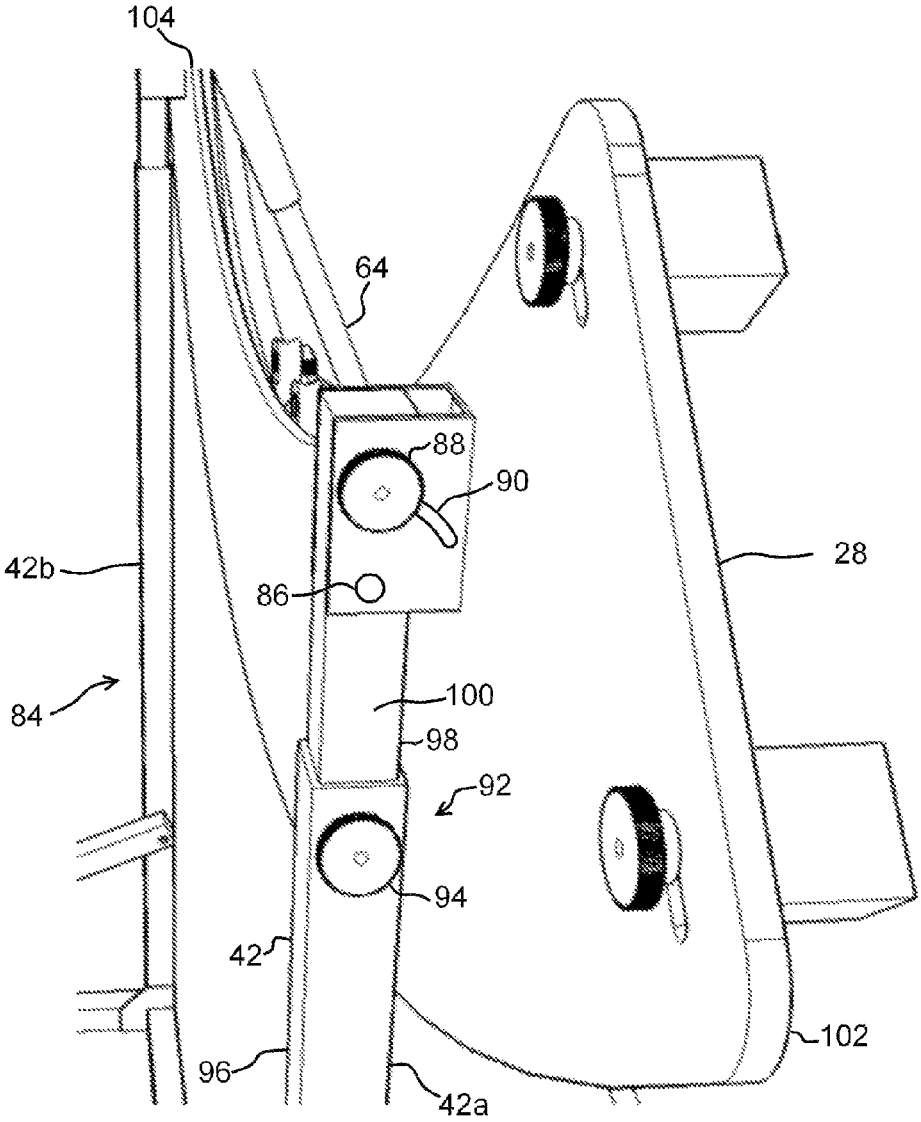
FIG. 5 is a perspective detail view showing a rearward portion of the apparatus.

Looking to FIG. 5, a tilt adjustment mechanism 84 allows user to adjust the angle of the base rail 28 in a vertical plane perpendicular to the axis of rotation of a pivot 86. In the embodiment shown, this is accomplished by releasing the locking knob 88, rotating the base rail 28 to the desired angle, then re-tightening the locking knob 88. In one form, a shaft of the locking knob 88 travels in the channel 90. In another configuration, the locking knob 88 functions as the pivot also, and thus the channel 90 may be omitted.

Looking to FIG. 5, a configuration wherein the support 42 comprises a right leg 42A and a left leg 42B is disclosed. In this configuration, as there are generally two tilt adjustment systems 84, one on each leg, the locking knob 88 may well function as the pivot 86. Thus, the channel 90 may be omitted as being superfluous where two locking knobs provide sufficient restraint.

Also shown in this configuration is a height adjustment system 92 in one form comprising a locking knob 94 having a threaded shaft which engages a threaded portion of a lower leg portion 96. An upper leg portion 98 may fit within the lower leg section in a telescoping manner. Thus, as the locking knob 94 is tensioned, the shaft may engage the outer surface 100 of the upper leg portion 98. Thus fixing the upper leg portion 98 in place relative to the lower leg portion 96. In this way, the height of the base rail 28 may be adjusted. Furthermore, given a certain degree of flexibility in the support 42, the height of the base rail 28 on the right side 102 may be adjusted separately from the height of the base rail 28 at the left side 104 to offset the arc of the base rail for a particular user.

Figure 6:
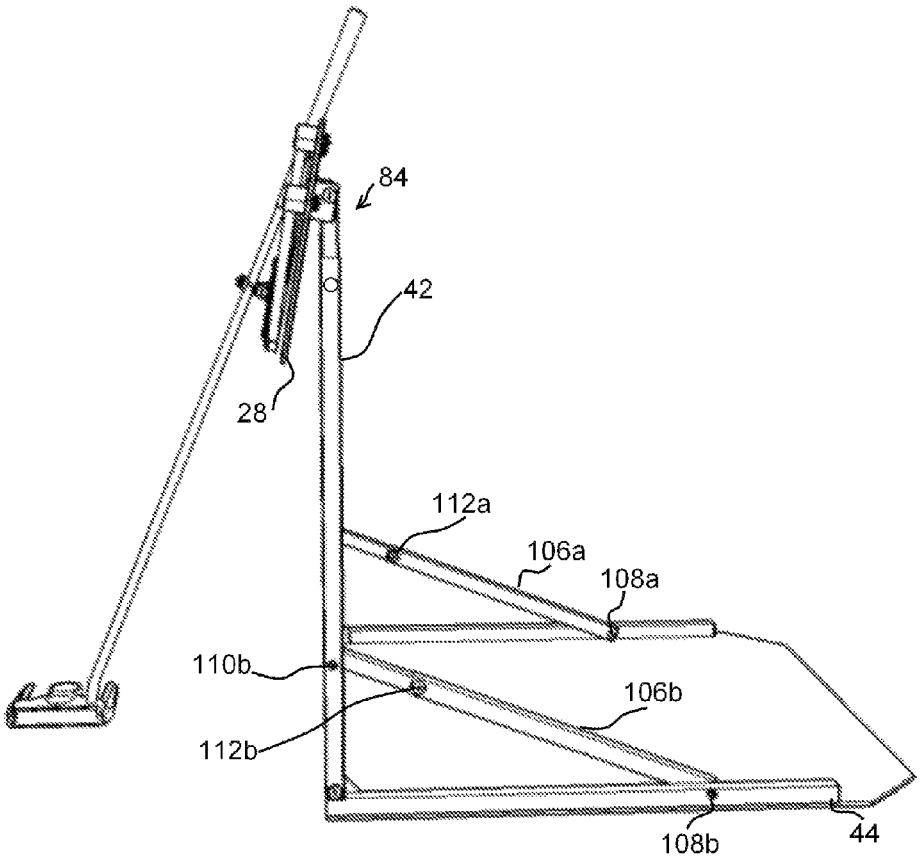
FIG. 6 is a perspective side view of the disclosed apparatus in a tilted configuration

Looking to FIG. 6, it can be seen how this configuration of the base rail 28 has been pivoted slightly clockwise such that the back side of the base rail 28 is no longer aligned with the support 42. This engagement of the tilt adjustment system 84 has been previously discussed and may be employed to provide the proper ark for a particular golf student.

Rigidity can be improved in the apparatus by the addition of support struts 106. In particular, right leg 42*a* may be supported by a right support strut 106*a*, and the left leg 42B may be supported I a left support strut 106*b*. In one form, each of the support struts 106 is connected at a lower pivot 108 to the frame portion 44 and is also connected to the associated leg 42 at an upper pivot 110. In one form, each support strut 106 comprises a length adjustment system 112 which may operate in a similar manner to the height adjust the system 92 previously disclosed.

Figure 7:
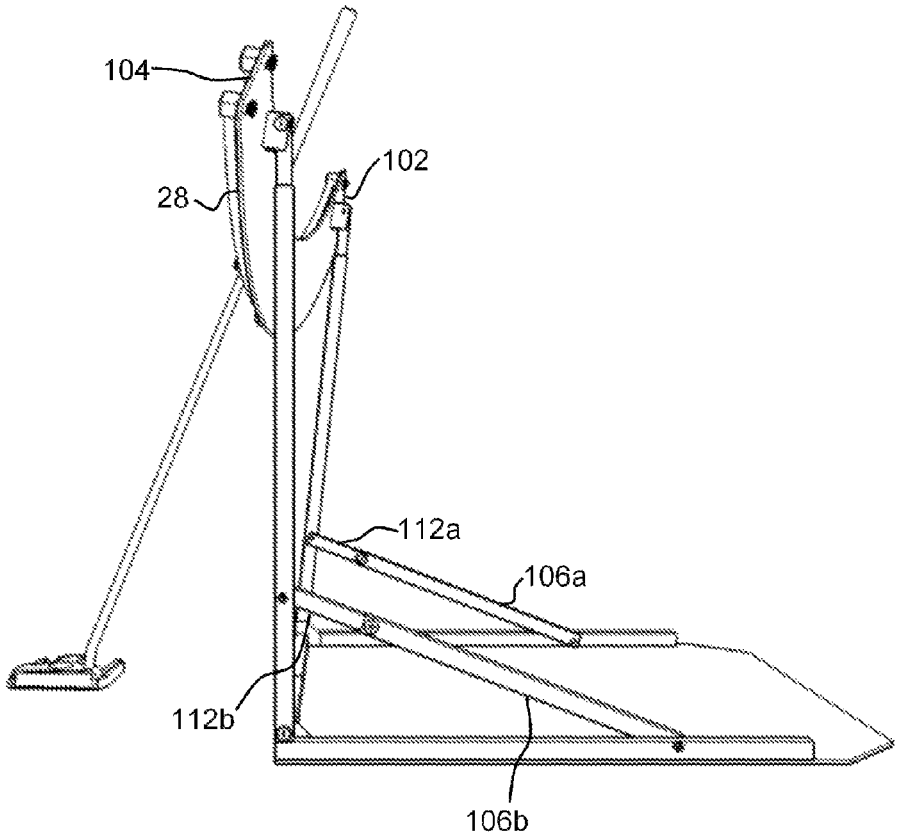
FIG. 7 is a perspective side view of the disclosed apparatus in an offset and tilted configuration.

Looking to FIG. 7, it can be seen how the base rail 28 may be offset in another manner when one of the support struts 106 is shortened a differential amount relative to the opposing support strut. For example, in the configuration shown in FIG. 7, the right report strut 106*a* has been shortened at the length adjustment system 112*a* a greater amount than the left support strut 106*b* at the left length adjustment system 112*b*. This functions to move the right side 102 rearward relative to the left side 104 further providing a level of adjustability to the arc through which the carriage transitions.

The two legs may be similarly asymmetrically offset when the height adjustment systems are not set equally.

Figure 8:
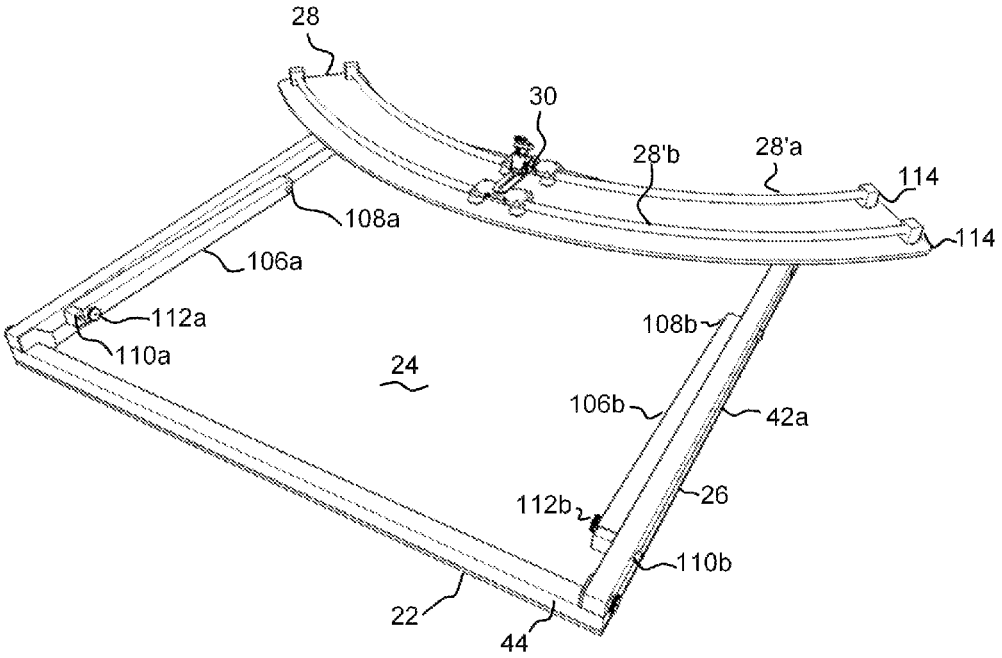
FIG. 8 is a perspective view of the disclosed apparatus in a folded or stowed configuration.
Figure 9:
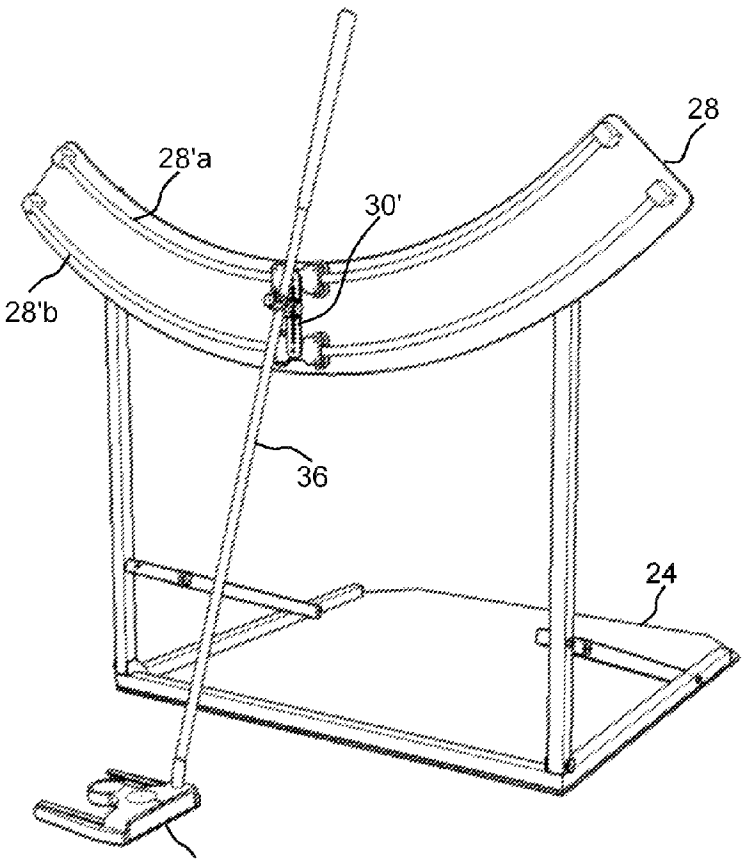
FIG. 9 is a perspective view of the disclosed apparatus.

Looking to FIG. 8, it can be seen how for transport or stowage, the support struts 106 have been significantly shortened such that the legs 42*a* and 42*b* lie substantially against the frame portion 44. Additionally, the end supports 114 may be configured so as to provide a malleable or other form of bumper to maintain the carriage 30 on the sub rails 28'*b* and 28'*a*. However, the end supports 114 may be configured and/or repositioned to allow the carriage 30 to be removed from the base rail 28 for storage of the apparatus. Removal of the carriage 30 further reduces the vertical profile of the apparatus, and may allow the carriage 30 to be stored in a smaller, potentially more secure place, as the carriage generally has more delicate moving parts than the other components. While the present invention is illustrated by description of several embodiments and while the illustrative embodiments are described in detail, it is not the intention of the applicants to restrict or in any way limit the scope of the appended claims to such detail. Also, several components have been depicted in separate drawings, but may be combined in ways not particularly shown. For example, the height adjustment system 92 is shown in a two legged configuration of FIG. 5, but could easily be incorporated into the single legged embodiment of FIG. 1. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A golf swing training device for particular application to teaching of putting and/or chipping, the golf swing training device comprising:

a. a platform;

b. a support leg having a first end pivotally connected to the platform and extending vertically therefrom;

c. a substantially rigid arcuate base rail pivotally coupled to a second end of the support leg;

d. a carriage plate positionally attached to the base rail so as to reposition relative thereto through a swing arc; and e. a golf club handle clamp pivotally attached to the carriage plate by way of a carriage pivot so as to fixedly attach a golf club thereto;

f. a clamp slider between the golf club handle clamp and the carriage pivot to allow movement of the golf club handle relative to the carriage plate along a club alignment axis.

2. The golf swing training device as recited in claim 1 wherein the arc of the base rail is less than 180°.

3. The golf swing training device as recited in claim 1 wherein the platform comprises an upper surface upon which a trainee stands.

4. The golf swing training device as recited in claim 1 wherein the platform does not extend forward of a club alignment axis.

5. A golf swing training device for particular application to teaching of putting and/or chipping, the golf swing training device comprising:

a. a platform;

b. a support leg having a first end pivotally connected to the platform and extending vertically therefrom;

c. a substantially rigid arcuate base rail pivotally coupled to a second end of the support leg;

d. a carriage plate positionally attached to the base rail so as to reposition relative thereto through a swing arc; and e. a golf club handle clamp pivotally attached to the carriage plate by way of a carriage pivot so as to fixedly attach a golf club thereto;

f. a carriage pivot between the carriage plate and the golf club handle clamp so as to allow for selective adjustment of the golf club handle clamp relative to the carriage plate in a vertical plane substantially perpendicular to the base plate; and g. wherein the carriage pivot is fixed in place during operation of the training device.

6. The golf swing training device as recited in claim 5 further comprising:

a. a clamp slide between the carriage plate and the golf club handle clamp to allow for selective linear and vertical adjustment of the golf club handle clamp relative to the carriage plate; and b. wherein the clamp slide is fixed in place during operation of the training device.

7. The golf swing training device as recited in claim 5 further comprising:

a. an upper and a lower sub rail attached to upper and lower portions of the base rail respectively; and b. wherein the carriage plate is positionally attached to the sub rails.

8. The golf swing training device as recited in claim 7 wherein the arc of the base rail is less than 180°.

9. The golf swing training device as recited in claim 5 further comprising:

a. a height adjustment system between the platform and the base rail;

b. wherein the vertical position of the base rail may be selectively adjusted; and c. wherein the height adjustment system is fixed during operation of the training device.

10. The golf swing training device as recited in claim 5 further comprising:

a. a support strut having a first end pivotally attached to the platform; and b. the support strut having a second end pivotally attached to the support leg.

11. The golf swing training device as recited in claim 10 further comprising:

a. a support strut length adjustment system; and b. wherein the support strut length adjustment system provides for adjustment of the distance between the first end and the second end of the support strut such that an angle of the support leg relative to the platform may be selectively adjusted.

12. The golf swing training device as recited in claim 5 wherein the support leg comprises:

a. a left side leg and a right side leg each independently attached to the platform; and b. wherein each of the left side leg and right side leg are independently attached to the base rail.

13. The golf swing training device as recited in claim 12 wherein each of the left side leg and right side leg comprise a height adjustment system independent of the height adjustment system of the opposing side leg.

14. The golf swing training device as recited in claim 12 further comprising:

a. a left side support strut having a first end pivotally attached to the platform; and b. the left side support strut having a second end pivotally attached to the left side leg;

c. a right side support strut having a first end pivotally attached to the platform; and d. the right side support strut having a second end pivotally attached to the right side leg.

15. The golf swing training device as recited in claim 14 wherein each of the left side support strut and right side support strut comprise a length adjustment system independent of the length adjustment system of the opposing support strut.

16. The golf swing training device as recited in claim 5 wherein the arc of the base rail is less than 180°.

17. A golf swing training device for particular application to teaching of putting and/or chipping, the golf swing training device comprising:

a. a platform;

b. a support leg having a first end pivotally connected to the platform and extending vertically therefrom;

c. a substantially rigid arcuate base rail pivotally coupled to a second end of the support leg;

d. a carriage plate positionally attached to the base rail so as to reposition relative thereto through a swing arc;

e. a golf club handle clamp pivotally attached to the carriage plate by way of a carriage pivot so as to fixedly attach a golf club thereto;

f. an upper and a lower sub rail attached to upper and lower portions of the base rail respectively;

g. wherein the carriage plate is positionally attached to the sub rails; and h. a sub rail position adjustment system wherein the position of one or both of the upper and lower sub rails may be adjusted relative to the base rail; and i. wherein the sub rail position adjustment system is fixed in place during operation of the training device.

18. The golf swing training device as recited in claim 17 further comprising:

a. a first carriage sub plate pivotally attached to the carriage plate and positionally attached to the upper sub rail; and b. a second carriage sub plate pivotally attached to the carriage plate and positionally attached to the lower sub rail.

19. A golf swing training device for particular application to teaching of putting and/or chipping, the golf swing training device comprising:

a. a platform;

b. a support leg having a first end pivotally connected to the platform and extending vertically therefrom;

c. a substantially rigid arcuate base rail pivotally coupled to a second end of the support leg;

d. a carriage plate positonally attached to the base rail so as to reposition relative thereto through a swing arc;

e. a golf club handle clamp pivotally attached to the carriage plate by way of a carriage pivot so as to fixedly attach a golf club thereto;

f. an upper and a lower sub rail attached to upper and lower portions of the base rail respectively; and g. a tilt adjustment system between the base rail and the support leg;

h. where the tilt adjustment system provides for selective adjustment of the base rail relative to the support leg in a vertical plane perpendicular to the base rail; and i. wherein the tilt adjustment system is fixed during operation of the training device.

20. The golf swing training device as recited in claim 19 wherein the arc of the base rail is less than 180°.

* * * * *